United States Patent [19]

Kindlimann

[11] Patent Number: 4,464,207

[45] Date of Patent: Aug. 7, 1984

[54] DISPERSION STRENGTHENED FERRITIC STAINLESS STEEL

[75] Inventor: Lynn E. Kindlimann, Woodland Hills, Calif.

[73] Assignee: The Garrett Corporation, Los Angeles, Calif.

[21] Appl. No.: 933,396

[22] Filed: Aug. 14, 1978

[51] Int. Cl.[3] ..... C22C 38/28; C23C 11/16

[52] U.S. Cl. ..... 148/16.6; 148/37

[58] Field of Search ..... 75/126 J, 126 D; 148/16, 16.6, 37

[56] References Cited

U.S. PATENT DOCUMENTS

| | | | |
|---|---|---|---|
| 3,615,904 | 10/1971 | Kindlimann et al. | 148/12.1 |
| 3,632,456 | 1/1972 | Sakakura et al. | 148/112 |
| 3,804,678 | 4/1974 | Kindlimann | 148/38 |
| 3,928,088 | 12/1975 | Schlosser et al. | 148/37 |
| 4,046,601 | 9/1977 | Hook | 148/16.6 |

FOREIGN PATENT DOCUMENTS

| | | | |
|---|---|---|---|
| 1407407 | 9/1975 | United Kingdom | 148/16.6 |

OTHER PUBLICATIONS

Smith et al., "Identification of Phases in a Nitrided Stainless Steel", Jour. Iron & Steel Inst., Jan. 1973, pp. 34–36.

Chen, "Dispersion Strengthening of Iron Alloys by Internal Nitriding", PhD Thesis, RPI, Troy, N.Y., 8/65.

Kindlimann et al., "Dispersion Strengthening Austenitic Stainless Steels by Nitriding", *Metallurgical Transactions,* vol. 1, (2/70), pp. 507–515.

*Primary Examiner*—Peter K. Skiff

*Attorney, Agent, or Firm*—Donald W. Canady; Joel D. Talcott; Albert J. Miller

[57] ABSTRACT

Through-nitrided light gage ferritic stainless steels having a dispersion of metal-nitride particles at an interparticle spacing of less than about 10 microns. The resulting material has substantially improved strength at room and elevated temperatures over conventional ferritic stainless steels, exhibits ductility markedly above that commonly associated with nitrided articles, and is stronger than conventional 18Cr-8Ni austenitic stainless steel (T-304) for prolonged service above about 1400° F. The nitriding is accomplished with atomic nitrogen at 1500°–1800° F. followed by heating to above 1800° F. in a non-oxidizing atmosphere to remove excess nitrides.

16 Claims, 8 Drawing Figures

DISPERSION STRENGTHENED FERRITIC STAINLESS STEEL

BACKGROUND OF THE INVENTION

Nitriding of iron-based alloys in a gaseous ammonia atmosphere at elevated temperatures has been practiced for many years to produce hard, wear-resistant surfaces on steel parts. The ammonia dissociates, or decomposes, to release atomic nitrogen, [N], which reacts with alloying elements (e.g., aluminum, chromium, vanadium, etc.) which have been added to the steel to improve nitriding response, by forming finely dispersed nitride particles which impart the hard layer to the surface of the metal parts. Since nitrides from this group of alloying elements are somewhat unstable, tending to coarsen at temperatures in excess of about 1200° F., (which results in softening of the surface), conventional nitriding is carried out at temperatures of about 1000° F. The resulting nitrided parts are then limited to maximum service temperatures significantly below 1000° F. Further, because of the relatively low treatment temperatures, the diffusion of nitrogen is slow, and nitriding treatment times of up to 50 hours are often needed to achieve hardened surface layers in the range of 0.010 to 0.020 inches thickness. In the case of stainless steels nitrided for improved surface hardness, corrosion resistance is normally reduced because the major element, chromium, is precipitated from the base material as a nitride and is no longer free to perform its role as the solid solution element which makes the alloy "stainless".

Recently, titanium-alloyed steels have been nitrided. It has been demonstrated that titanium nitride particles are very stable in a steel matrix, even at temperatures in the vicinity of 2000° F. Thin-section iron-titanium alloy parts have been nitrided throughout their cross section to produce very high strength alloys. Similarly, through nitriding has been done with titanium-containing austenitic stainless steels as disclosed in Kindlimann U.S. Pat. No. 3,804,678, entitled "Stainless Steel by Internal Nitridation". The teachings of this prior patent, might, at first glance, appear applicable to other classes of stainless steels, i.e. ferritic stainless steels, however, on further analysis, the internal nitridation of the normally non-hardenable ferritic grades of stainless steels is not indicated. Chen, for example, found embrittlement due to the massive chromium nitrides formed when he attempted to nitride iron alloys containing 26 percent chromium and 3 and 5 percent titanium (F. P. H. Chen, "Dispersion Strengthening of Iron Alloys by Internal Nitriding", PhD Thesis, Rensselaer Polytechnic Institute, Troy N.Y. (August 1965)). Similarly, it was found that when titanium containing austenitic stainless steels are subjected to nitridation in such a manner as to achieve the low interparticle spacing of stable nitride particles as claimed in U.S. Pat. No. 3,804,678, massive chromium nitrides are also formed during the treatment. While such chromium nitrides may be eliminated by a denitriding step involving a treatment in a nitrogen-free atmosphere at elevated temperatures after the nitridation step, such removal tends to leave relatively large subsurface pores in the stainless steel surface. These pores lead to reduced tensile strength and ductility, and lower creep strength. See L. E. Kindlimann and G. S. Ansell, "Dispersion Strengthening Austenitic Stainless Steel by Nitriding", *Metallurgical Transactions,* Vol. 1 (February, 1970) pp 507–515. Furthermore, in this article, the authors observed that such pore formation became more severe at lower nitriding temperatures, i.e. below about 1900° F.

While subsurface pores may be eliminated through a post-nitriding hot working step used to bond packets of thin strip or powder into heavier gage sheet, bars, forms, etc., this consolidation step is costly, particularly when the final gage sheet required is within the capability of the through nitriding process. Elimination of the pores, while maximizing high temperature strength of nitride strengthened ferritic stainless steel grades in thin gages up to about 0.020 inches thickness, has important engineering and economic implications to design and fabrication of energy saving heat recovery devices. For such an application, ferritic stainless steels are preferred over austenitic types because of lower thermal expansion (lower thermal stress and less distortion), higher resistance to oxide scaling (longer life and/or lighter weight), and freedom from stress corrosion cracking (catastrophic failure). Nonetheless, implementation of standard ferritic grades has been hampered by low strength at elevated temperatures, and the use of more costly higher strength nickel based and cobalt based alloys is often found necessary. The result is a long pay-back period for the energy recovery devices, which has adversely influenced acceptance of the need to install heat recovery devices.

SUMMARY OF THE INVENTION

My present invention involves dispersion strengthening a light gage ferritic stainless steel by nitriding through the entire cross section of the material. The stainless steel of my present invention is in the form of cold reduced thin section sheet and strip or thin section cast parts. The resulting internally through-nitrided steel has improved strength at room temperature and is markedly strengthened at elevated temperatures. Concurrently, subsurface pore formation is essentially eliminated. The nitride-strengthened ferritic stainless steels produced in accordance with my present invention will provide for a much faster pay-back period, and make heat recovery devices more acceptable.

The ferritic stainless steels treated in accordance with my present invention encompass the general range of chemistry common to AISI Type 400 ferritic stainless steel, e.g., Types 409 and 439 stainless steels, which contain about 10 to 20 percent chromium, about 0.75 titanium maximum and about 0.08 percent carbon maximum. Types 409 and 439 are generally recognized designations respectively, for 10.5–12% chromium and 17.75–18.75% chromium, titanium-stabilized ferritic stainless steels whose complete chemistry and properties are well-documented in the literature. According to my present invention, the chemistry of the above ferritic stainless steels is modified by increasing the overall titanium level to about 0.5 to 2.25 percent and reducing the carbon content to about 0.03 percent maximum. The nitridation temperature is then selected to yield the best combination of desired property levels and treatment time for a given application. It should be noted that merely increasing the titanium level of a ferritic stainless steel, such as Type 409 does not appreciably increase the high temperature tensile and creep strength properties.

DESCRIPTION OF THE PREFERRED EMBODIMENTS

Figure 2:
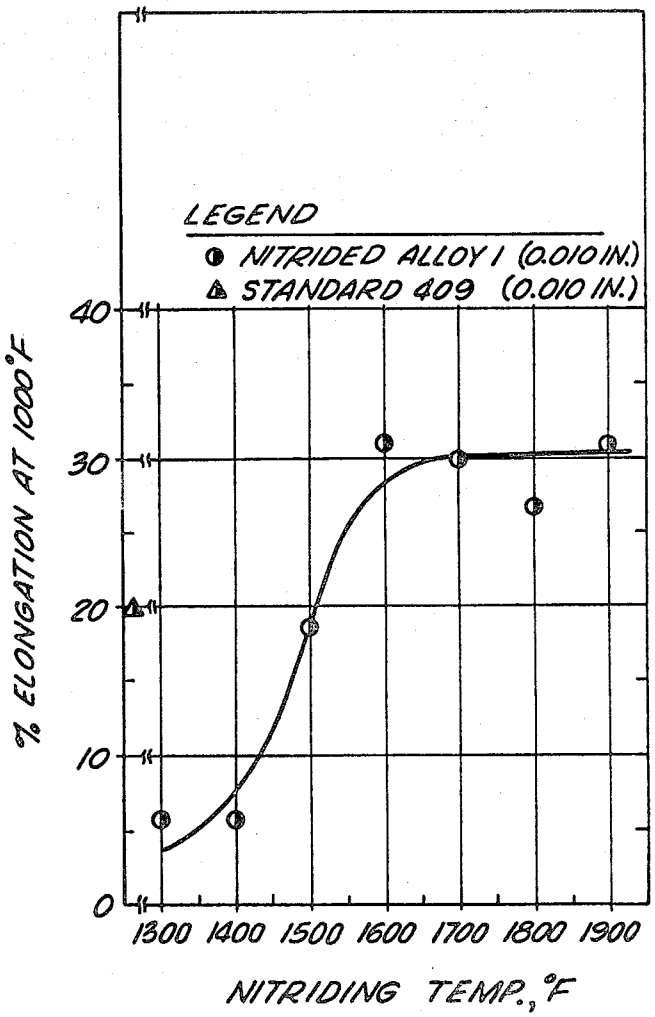
FIG. 2 is a graphical representation in respect to the same modified stainless steel, showing tensile ductility (% elongation at 1000° F.) plotted versus nitriding temperature.

In accordance with my present invention, it has been discovered that in through nitriding relatively thin-section, i.e. light gage, ferritic stainless steel for improved high temperature yield and creep strength, the titanium nitride particle shape becomes plate-like and progressively more enlarged at nitriding temperatures above about 1800° F., which adversely affects the high temperature strength properties of the nitrided ferritic stainless steel material. The plate-like nitrides formed at these nitriding temperatures results in substantially greater interparticle spacing of the titanium nitride particles. Conversely, the coarsening of the titanium nitride particles does not occur in nitridation of austenitic stainless steel until a treating temperature of about 2100° to 2200° F. is employed, and, even then, coarsening is not as deleterious as in the ferritic stainless steel, probably because of faster diffusion of titanium in ferritic steels. In particular, plate-like particles have not been observed in the austenitic grades, hence the nitridation process for nitriding austenitic stainless steels, with an optimum nitriding temperature of about 1900° F. as taught in U.S. Pat. No. 3,804,678, is not applicable to ferritic stainless steels. On the other hand, it has been found that the through nitridation of ferritic stainless steels at temperatures below about 1400° F. results in the formation of heavy intergranular particles which cause severe mechanical damage, actually splitting the material along grain boundaries. It was discovered in accordance with my present invention, that nitride strengthening of ferritic stainless steels must be done by first increasing the titanium level to about 0.5 to 2.25 percent, and then nitriding the material at temperatures between about 1500° and 1800° F. in order to obtain a through nitrided material which, after denitriding, is essentially pore free and has substantially improved strength at both room and elevated temperatures.

To demonstrate my present invention, alloys 1–8, whose compositions are shown in Table I, were cold rolled to thin gage strip, typically 0.010 inches thick. Other thicknesses of the 409 based alloys 1–4 are shown in Table II and FIG. 4. Alloys 1 and 7, conventionally strand annealed, and alloys 2–6 and 8, as cold rolled (approx. 50 percent reduction to final gage), were treated in a retort with flowing ammonia gas at the temperature and for typical nitriding durations as shown in Table II. The ammonia flow rate was at a sufficiently high level to achieve essentially the maximum nitriding rate for each nitriding temperature. Higher nitriding temperatures required higher flow rates because of greater ammonia dissociation on the retort internal surfaces. A constant supply of atomic nitrogen was sought to maintain saturation of nitrogen in the surface layers of the material. Heating of the retort was accomplished through the use of an electric globar-type furnace. In several instances, i.e. 0.004 inch thick alloy 1 and 0.010 inch thick alloy 3 (Table II and FIG. 4), samples were prepared in larger quantities in a production size bell-type retort furnace using the same principles as in the small retort, with gas (both ammonia for nitriding and hydrogen for denitriding) flow rates increased to account for the larger workload and greater retort volume.

Following the nitridation of Alloys 1–8, flowing hydrogen gas was introduced into the retort (at the nitriding temperature) and the retort was heated to 2025° F. (nominally) and typically held for about three hours with continuous hydrogen flow. Following the denitriding cycle, the samples typically were cooled to room temperature in an inert atmosphere, i.e. argon. Prior to testing, alloys 1–4 were given an additional anneal to eliminate any martensite which may have formed on cooling, as these materials are substantially austenitic at the denitriding temperature due to removal of titanium as the nitride. Alloys 5–8, fully ferritic, were typically slow-cooled to 1600° F. after denitriding, where the retort was removed from the furnace. The samples were then machined and tested in accordance with conventional ASTM procedures for tensile and creep properties.

TABLE I

COMPOSITIONS OF ALLOYS STUDIED

| Alloy No. | C | Mn | Si | Cr | Ni | Al | Ti | Mo | S | P | Fe |
|---|---|---|---|---|---|---|---|---|---|---|---|
| 1 | 0.015 | 0.45 | 0.17 | 11.44 | 0.31 | — | 1.04 | — | 0.002 | 0.021 | Bal. |
| 2 | 0.027 | 0.45 | 0.56 | 10.80 | 0.10 | 0.05 | 0.82 | — | 0.020 | 0.027 | Bal. |
| 3 | 0.012 | 0.58 | 0.57 | 11.25 | 0.13 | 0.05 | 1.78 | — | 0.010 | 0.011 | Bal. |
| 4 | 0.030 | 0.40 | 0.48 | 10.90 | 0.13 | 0.055 | 1.74 | — | 0.019 | 0.026 | Bal. |
| 5 | 0.013 | 0.48 | 0.30 | 17.80 | 0.04 | 0.09 | 1.21 | 2.11 | 0.005 | 0.005 | Bal. |

TABLE I-continued

COMPOSITIONS OF ALLOYS STUDIED

| Alloy No. | C | Mn | Si | Cr | Ni | Al | Ti | Mo | S | P | Fe |
|---|---|---|---|---|---|---|---|---|---|---|---|
| 6 | 0.014 | 0.48 | 0.31 | 13.94 | 0.04 | 0.09 | 1.24 | 3.99 | 0.005 | 0.005 | Bal. |
| 7 | 0.021 | 0.31 | 0.40 | 18.20 | 0.23 | — | 0.47 | 2.20 | 0.018 | 0.019 | Bal. |
| 8 | 0.028 | 0.44 | 0.34 | 11.98 | — | — | 0.59 | 1.93 | — | — | Bal. |

TABLE II

CREEP RUPTURE RESULTS FOR MATERIALS NITRIDED BETWEEN 1600 and 1730° F.

| ALLOY NO. | THICK-NESS (INCHES) | NITRIDING TEMP. (°F.) | NITRIDING TIME MINUTES** | TEST LOADING STRESS (KSI) | CREEP TEST TEMP. (°F.) | HOURS TO 1% CREEP | HOURS TO RUPTURE | ELON-GATION % |
|---|---|---|---|---|---|---|---|---|
| 409 | 0.010 | NONE* | 0 | 30.0 | 900 | 937 | DISCONTINUED | — |
| 409 | 0.010 | NONE* | 0 | 17.5 | 1000 | 689 | 1507 | 29 |
| 409 | 0.010 | NONE* | 0 | 8.0 | 1100 | 540 | DISCONTINUED | — |
| 409 | 0.010 | NONE* | 0 | 5.0 | 1200 | 1450 | " | — |
| 409 | 0.010 | NONE* | 0 | 3.0 | 1300 | 628 | 2752 | 23 |
| 1 | 0.010 | 1600 | 105 | 7.5 | 1400 | 5 | 54 | 13.5 |
| 1 | 0.010 | 1600 | 105 | 6.5 | 1400 | 10 | DISCONTINUED | — |
| 1 | 0.010 | 1600 | 54 | 6.0 | 1400 | 98.7 | 115 | 4.5 |
| 1 | 0.010 | 1700 | 49 | 6.0 | 1400 | 70.5 | 143 | 8.5 |
| 1 | 0.010 | 1600 | 54 | 4.0 | 1800 | 2.0 | 6.0 | 10.0 |
| 1 | 0.004 | 1600 | 25 | 13.5 | 1100 | 0.5% | at 83 hrs.(DISC) | |
| 1 | 0.004 | 1600 | 25 | 13.5 | 1100 | 0.5% | at 140hrs.(DISC) | |
| 1 | 0.004 | 1600 | 25 | 13.5 | 1100 | 410 | DISCONTINUED | — |
| 1 | 0.004 | 1600 | 25 | 12.5 | 1100 | 0.5% | at 125hrs.(DISC) | |
| 1 | 0.004 | 1600 | 25 | 11.0 | 1100 | 0.5% | at 167hrs.(DISC) | |
| 1 | 0.004 | 1600 | 25 | 9.5 | 1250 | 0.5% | at 190hrs.(DISC) | |
| 1 | 0.004 | 1600 | 25 | 9.5 | 1250 | 0.5% | at 640hrs.(DISC) | |
| 1 | 0.004 | 1600 | 25 | 8.0 | 1250 | 0.5% | at 470hrs.(DISC) | |
| 1 | 0.004 | 1600 | 25 | 7.25 | 1400 | 405 | DISCONTINUED | — |
| 1 | 0.004 | 1600 | 25 | 7.25 | 1400 | 0.5% | at 116hrs.(DISC) | |
| 1 | 0.004 | 1600 | 25 | 7.25 | 1400 | 0.5% | at 365hrs.(DISC) | |
| 2 | 0.008 | 1700 | 30 | 7.0 | 1500 | 4.1 | 32.4 | 8.5 |
| 2 | 0.004 | 1700 | 30 | 7.0 | 1500 | 8.5 | 39.4 | 4.5 |
| 3 | 0.010 | 1730 | 120 | 20.0 | 1200 | 15 | DISCONTINUED | — |
| 3 | 0.010 | 1730 | 120 | 8.9 | 1500 | 7 | 23 | 8 |
| 3 | 0.010 | 1730 | 120 | 8.5 | 1500 | 62 | 210 | 4 |
| 3 | 0.010 | 1730 | 120 | 8.5 | 1500 | 29 | DISC AT 908 | — |
| 3 | 0.010 | 1730 | 120 | 8.5 | 1500 | 28 | DISCONTINUED | — |
| 3 | 0.010 | 1730 | 120 | 8.5 | 1500 | 63 | 314 | 6 |
| 3 | 0.010 | 1730 | 120 | 8.5 | 1500 | 125 | DISCONTINUED | — |
| 4 | 0.007 | 1700 | 120 | 7.0 | 1500 | — | at 108 hrs.(DISC) | 0.2%creep |
| 5 | 0.010 | 1650 | 35 | 11.0 | 1400 | 3475 | at 3575 hrs.(DISC) | — |
| 5 | 0.010 | NONE* | — | 6.5 | 1300 | 6.8 | 75 | 37 |
| 6 | 0.011 | 1675 | 60 | 13.0 | 1400 | 779 | at 1508 hrs.(DISC) | 1.5 |
| 6 | 0.010 | NONE* | — | 6.5 | 1300 | 2.7 | 1131 | 22 |
| 7 | 0.010 | 1625 | 60 | 5.0 | 1500 | — | 2.1 | 68 |
| 7 | 0.010 | NONE* | — | 6.5 | 1300 | 4.8 | 19 | 32 |
| 8 | 0.010 | 1625 | 60 | 5.0 | 1500 | 474 | 814 | 4 |
| 8 | 0.010 | NONE* | — | 6.5 | 1300 | 1.3 | 28 | 42 |

Figure 1:
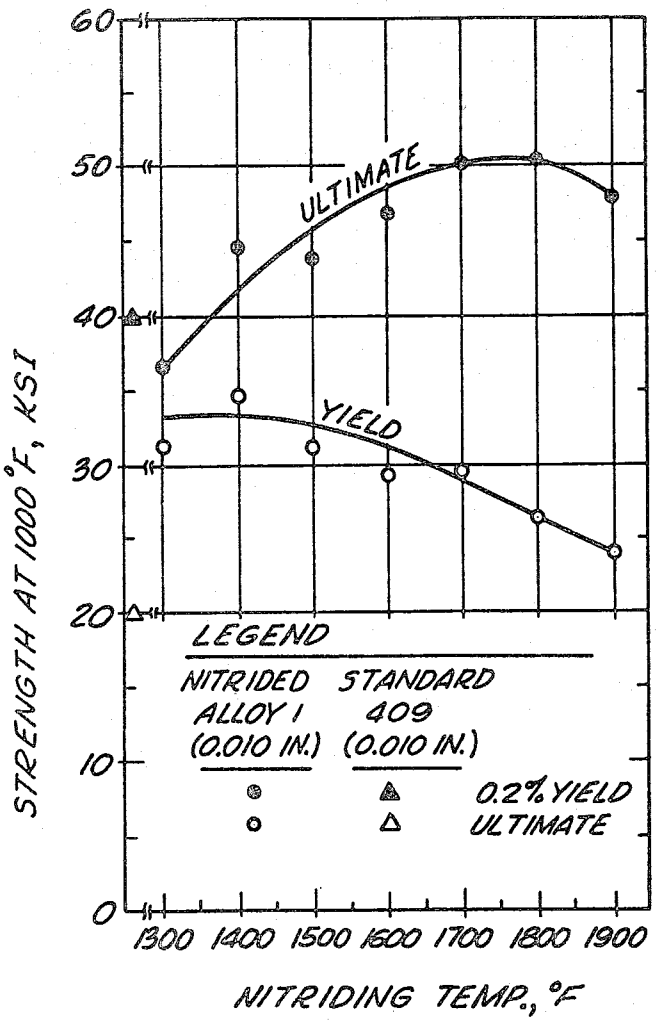
FIG. 1 is a graphical representation showing the effect on 1000° F. yield and tensile strengths, of Type 409 stainless steel, 0.010 inches thick, modified (and nitrided) in accordance with the present invention, plotted versus temperature of nitridation.
Figure 3:
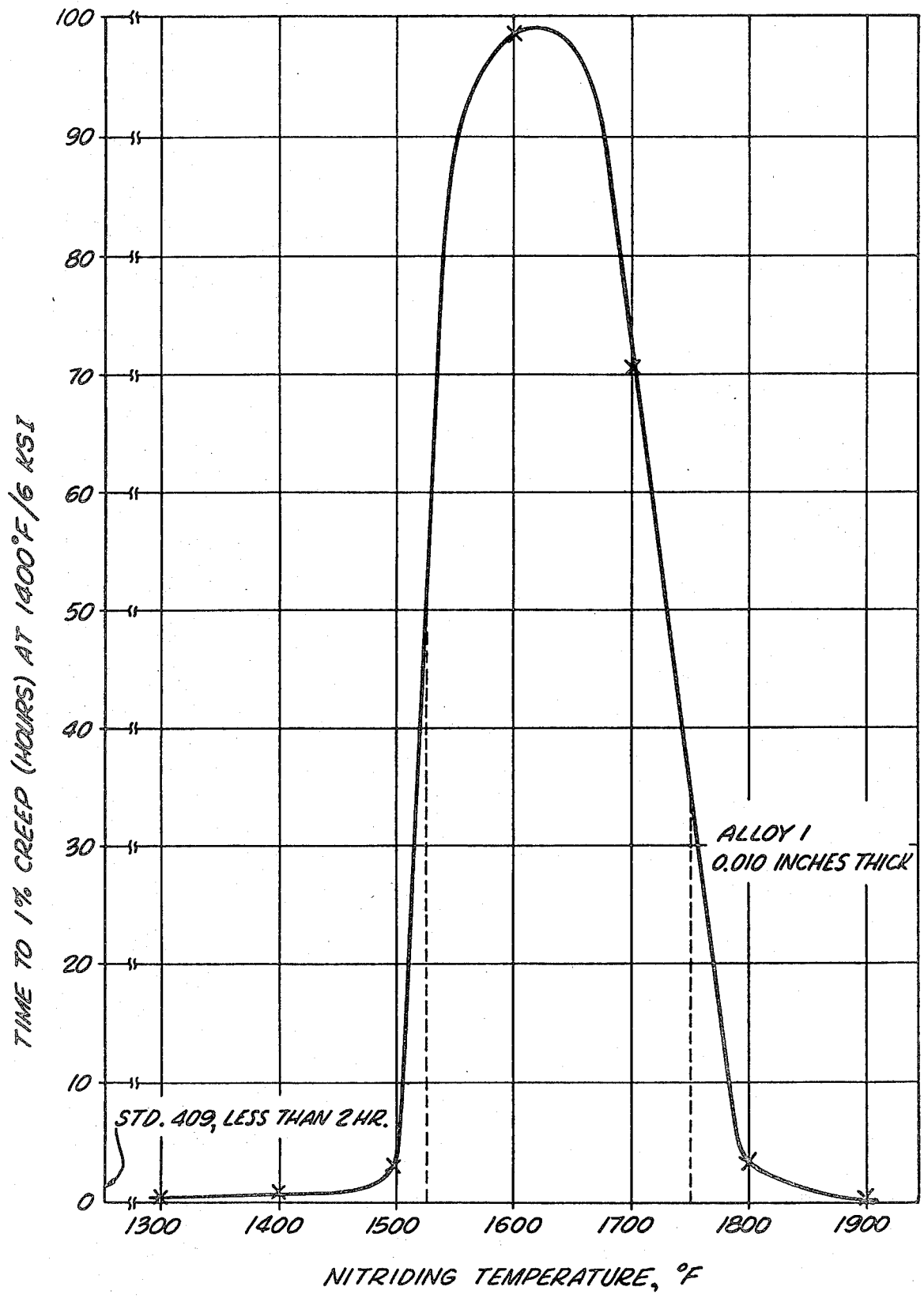
FIG. 3 is a graphical representation showing time to 1 percent creep extension under a 6,000 psi load at 1400° F. of nitride strengthened Type 409, 0.010 inches thick, modified (and nitrided) in accordance with this invention, plotted versus temperature of nitridation.
Figure 4:
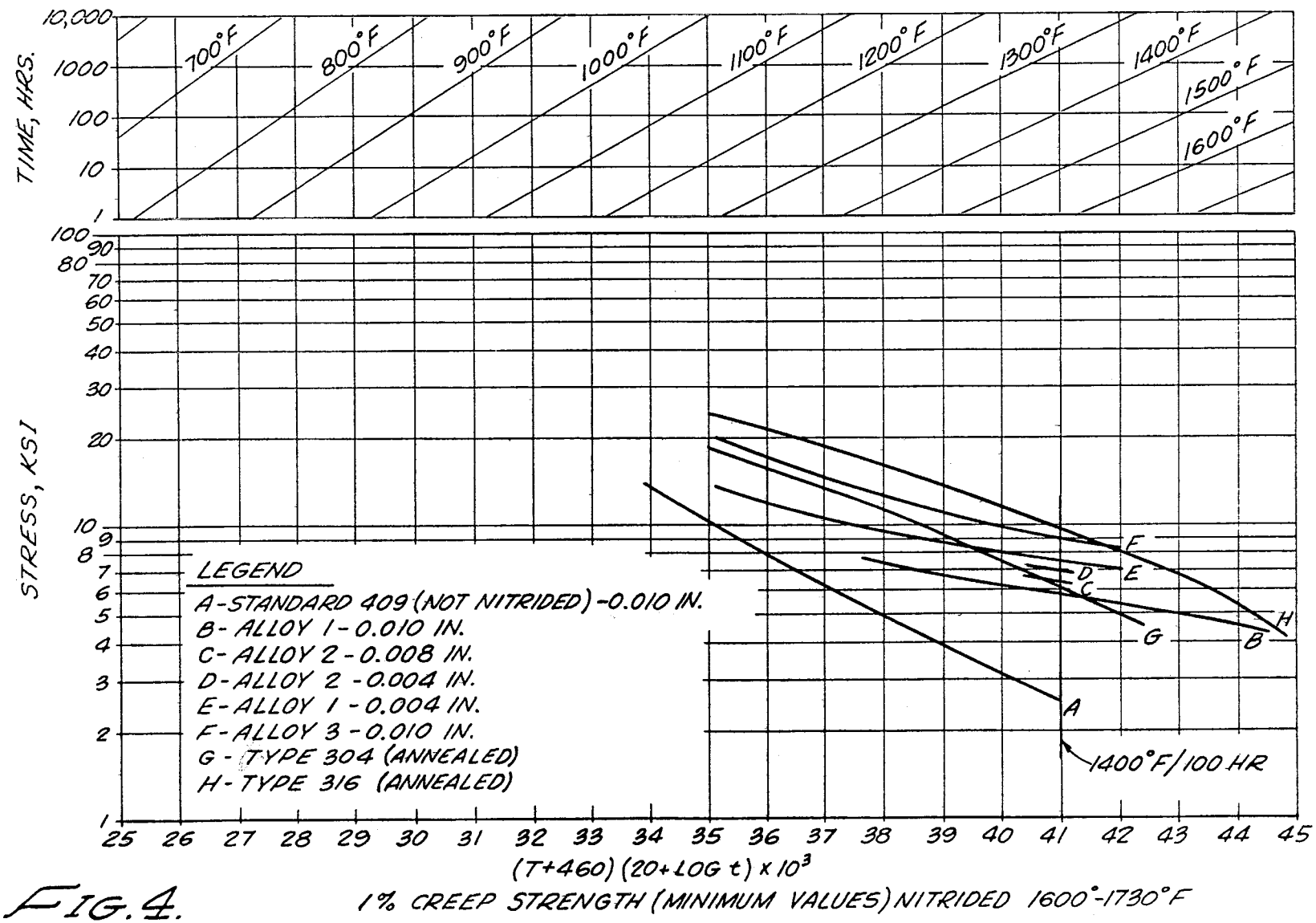
FIG. 4 is a graphical representation comparing the log stress to produce 1 percent creep for standard AISI 409 to modified 409 alloys treated in accordance with my present invention, plotted against the Larson-Miller master rupture parameter.

*409 WAS OF STANDARD ANALYSIS, 11.6% Cr, 0.41% Ti, and 0.066% C MATERIAL WAS SUBJECTED TO A THERMAL CYCLE SIMILAR TO A DENITRIDING TREATMENT PRIOR TO CREEP TESTING.
**THREE RETORTS USED - FLOW RATES VARY FOR EACH RETORT As shown in FIGS. 1–3, optimum elevated temperature properties, as measured by tensile and elongation tests at 1000° F. and creep tests at 1400° F., are obtained for alloy 1, a modified Type 409, by nitriding at temperatures between about 1525° and 1750° F. The data represented in FIG. 1–3 are for 0.010 inch thick material. FIG. 4 shows a 1% creep stress versus rupture parameter plot, comparing 0.004 inch thick material to 0.010 inch material (alloy 1 after nitriding at about 1600° F.). The decrease in strength with increasing gage, or thickness, is apparent, and is related to the longer nitriding times and correspondingly larger nitride particles toward the center of the strip. The curves of FIG. 4 are drawn through minimum data points. Additional data are given in Table II (for material nitrided between 1600° and 1730° F.).

At a given temperature, nitriding time is roughly related to the half-thickness squared for a given material, i.e. 0.010 inch thick material would require 25/4 times as long to nitride as 0.004 inch thick material, at the same titanium level. Likewise, material 0.032 inches thick would require over 10 times as long a nitriding time as 0.010 inch thick material.

Figure 5:
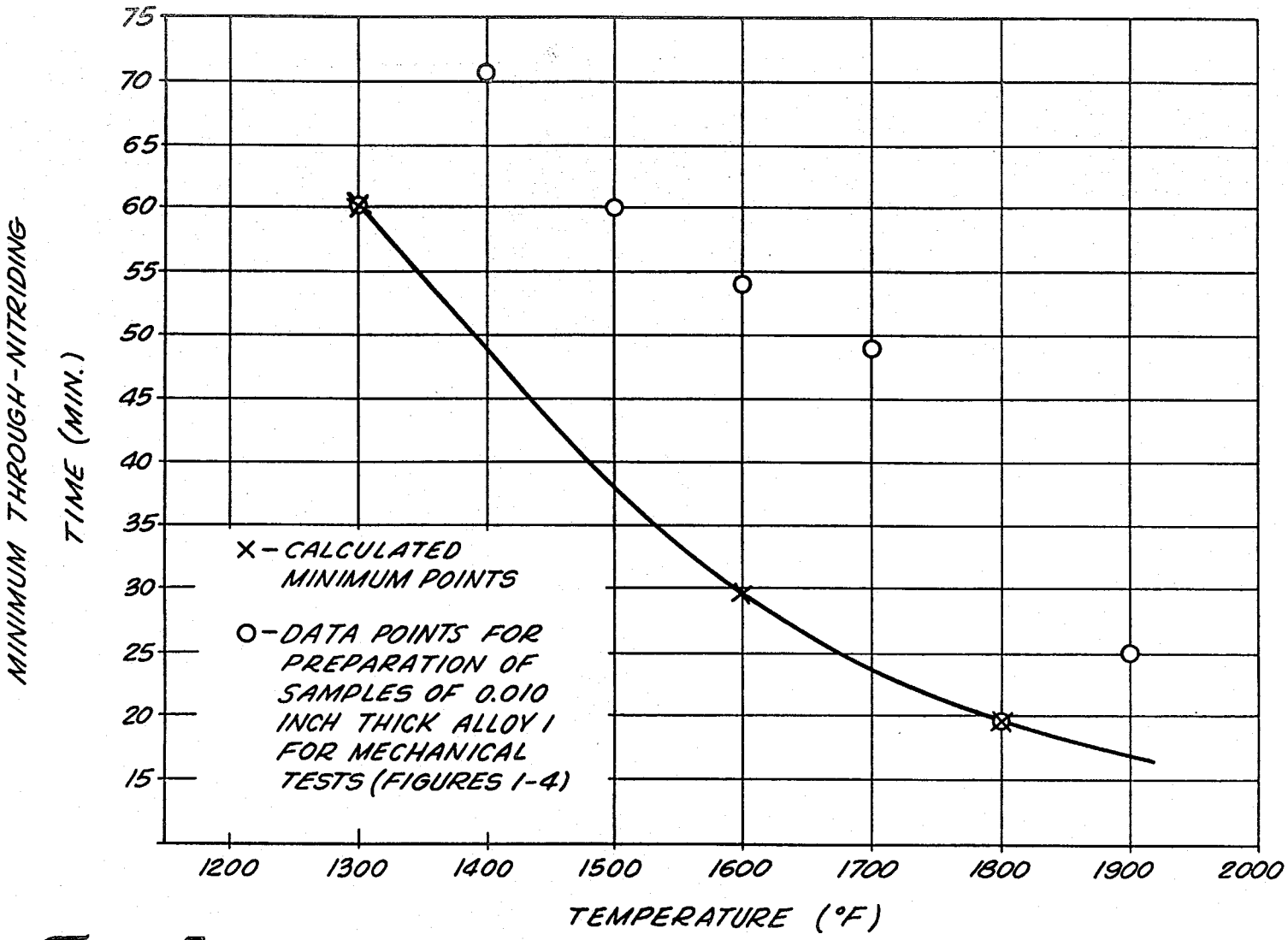
FIG. 5 is a graphical representation of minimum nitriding time versus nitriding temperature for 0.010 inch thick 409 stainless modified in accordance with my invention.

FIG. 5 is a constructed curve of minimum nitriding time for 0.010 inch thick alloy 1 versus nitriding temperature. This curve is determined empirically by deliberately undernitriding, measuring the maximum depth of titanium nitride formation, then calculating the time for full nitriding from the basic law of diffusion, $X^2=kt$, where X is distance, t is time, and k is a proportionality constant. In practice, some additional nitriding time over the minimum is generally allowed to account for non-uniform gas flow in the retort and minor variations in nitrogen absorption rate from piece to piece (surface roughness, cleanliness factors, etc.) For example, the data points marked on FIG. 5 correspond to the nitriding times used to prepare samples for the test results in FIGS. 1–3. The importance of achieving a high nitriding rate while minimizing over-nitriding (excessive chromium nitride formation) is discussed further below. FIG. 5 illustrates the relatively short time of nitriding treatment, necessary with the process of my present invention, i.e. less than one hour for 0.010 inch thick material having a titanium level similar to alloy 1. For the same material 0.032 inches thick, when the factor of 10 times is applied to the curve in FIG. 5, nitriding times of about 4 to 6 hours are required in the preferred temperature range of 1525° to 1750° F.

FIG. 4 and Table II show the general effect of titanium, comparing various gages of alloys 1, 2 and 3 from Table I. These data are shown plotted in FIG. 6 to demonstrate the importance of "effective" titanium level, defined below. With 0.03 percent maximum carbon in the starting material, a minimum of about 0.5 percent titanium is needed to ensure a reasonable strength improvement at elevated temperatures. Conversely, high titanium alloys are difficult to produce in light gages, and are more difficult to nitride because of greater sensitivity to oxygen contamination in the atmosphere, longer nitriding times, lower ductility, etc. Hence, about 2.25% titanium represents the upper limit for this element. Combining the optimum in producibility of starting material under 0.020 inches thick with a relatively short nitriding cycle, and substantial high temperature strengthening, places the preferred titanium range at about 0.9 to 1.5 percent.

Titanium may be stated in terms of an "effective" level, where %Ti "effective"=%Ti analyzed−4×%C. Thus, my "effective" titanium range is about 0.4 to 2.1%. Carbon levels higher than 0.03% would require correspondingly higher amounts of analyzed titanium to account for the titanium "lost" as a carbide, i.e not available for reaction with nitrogen during treatment to form the finer nitride particles needed for strengthening. It is also recognized that residual nitrogen will also be present and influence the % titanium "effective". Residual nitrogen is normally below about 0.01% in this type of material. This residual nitrogen must also be accounted for by reducing the analyzed titanium by a factor of 3.4×%N. Thus, the effective range of titanium, i.e. about 0.4 to 2.1%, is the amount of titanium employed in accordance with my present invention, which is in excess of the amount required to react completely with residual nitrogen and carbon in the alloy. Such "excess" titanium is substantially fully combined with nitrogen in the form of finely dispersed internal nitrides, in the alloys treated in accordance with my present invention. For example, the stoichiometric amount of nitrogen for 0.6% titanium is 0.175% as TiN.

Figure 6:
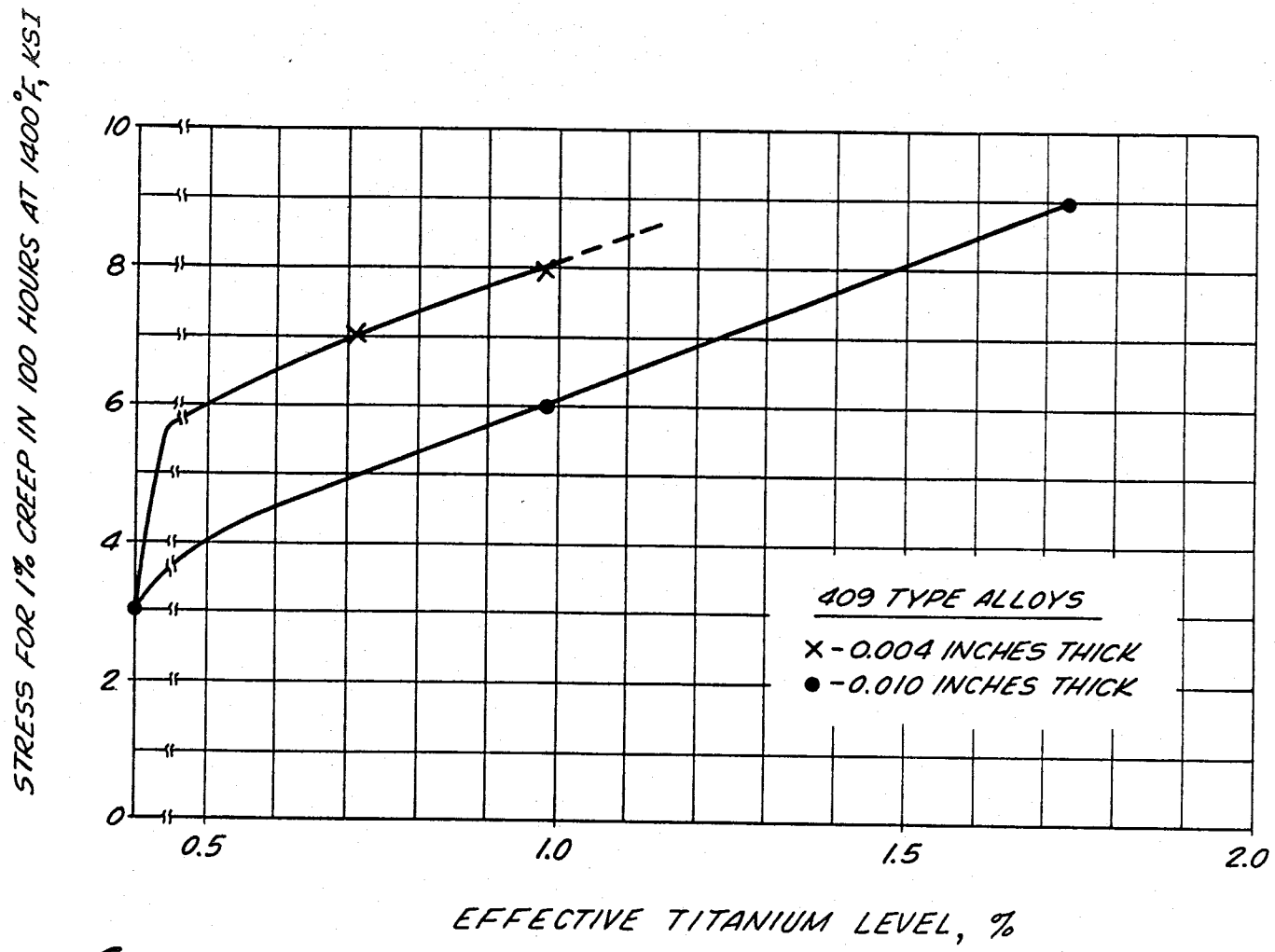
FIG. 6 is a graphical representation showing stress to produce 1 percent creep in 100 hours at 1400° F. versus "effective" percent titanium.

Although typical carbon levels for the base materials are typically between 0.04 and 0.06 percent, carbon levels in excess of 0.03% are generally undesirable, as carbon reduces the "effective" titanium level in the material, resulting in lower strength after nitriding as demonstrated in FIG. 6. It is desirable, therefore, to hold carbon to as low a level as possible. While carbon levels higher than 0.03 percent are tolerable, it becomes necessary to increase the titanium level of the material to compensate for a higher carbon level, if a given strength after nitriding in accordance with this invention, is to be achieved. However, adjustment of titanium level above about 2.25 percent will result in an alloy which is difficult to produce in lighter gage material. In particular, combinations of high titanium and high carbon often lead to large carbide particles in the starting ingot which are difficult to break up, resulting in holes in thin gage products.

Within the scope of my invention, the sheet thickness will be less than about 0.032 inches, the titanium will be about 0.5 to 2.25 percent, and the nitriding range will be about 1500° to 1800° F., which will result in a titanium nitride interparticle spacing on the average throughout the material of less than 10 microns, a spacing necessary for improvement of strength properties at elevated temperatures. Within the preferred embodiments of thickness less than about 0.020 inches, titanium 0.9 to 1.5 percent, and nitriding temperature 1525° to 1750° F., the titanium nitride interparticle spacing throughout the material will average less than about 2 microns, which leads to significantly improved elevated temperature properties over conventional ferritic stainless steels.

The importance of achieving a low titanium nitride interparticle spacing for improving strength, particularly at elevated temperatures, cannot be overemphasized. See, for example, the earlier referenced Kindlimann U.S. Pat. No. 3,804,678 and technical papers *Metallurgical Transactions* Vol. 1, January 1970 pp 163–170 and Vol. 1, February 1970 pp 507–515. The prior art generally indicates that small interparticle spacing increases properties at all temperatures when measured by conventional ASTM tensile and creep tests. A convenient method for quickly evaluating the effect of through-nitriding in producing a low interparticle spacing, is to measure the engineering 0.2% offset yield stress at room temperature. Typical results for alloys 1 and 4–8, nitrided in accordance with the preferred treatment by this invention, are shown in Table III. For comparison, data are also given for these same alloys subjected to a nitride thermal cycle followed by a denitride cycle in hydrogen (only) so that the material has seen the same thermal history, but without nitriding, i.e. simulated nitriding. Data are also given for similar materials which have not been titanium modified in accordance with this invention, and have been subjected to the standard mill anneal (conventionally, a few minutes at 1800° to 1900° F.) only. Depending on the material, room temperature yield strengths of the nitrided articles are observed to increase by 15 to 25 KSI over the articles simulated nitrided. In each case, the nitrided article has greater strength than the mill annealed material, in spite of the longer heat treatment (during denitriding) which is known to weaken mill products. However, the truly marked increase over the standard materials is shown by the 1000° F. tensile data, where at least a 50 percent improvement in yield strength is achieved. These data in Table III are in contrast to the results shown in the Arnold et al U.S. Pat. No. 4,047,981, where essentially no increase in yield strength was observed at room temperature between the nitrided articles and the same materials when simply annealed without nitriding.

Although improved creep strength is shown for the nitrided articles in the aforementioned Arnold et al patent, the very high temperature (982° C.) Sag Test used for measurement is not a conventional creep test, and does not show the true load-bearing characteristics of material. The 982° C. Sag Test, in which a sample is supporting only its own weight between two supports, is primarily a measure of grain boundary properties as influenced by grain boundary precipitates and related diffusion rates. In my present invention, the aim is to achieve improved creep strength/creep life in ferritic stainless steels for prolonged service at lower temperatures. Thus, the articles of my invention, through-nitrided within the preferred range of embodiments, i.e. with proportionally higher %Ti for heavier gage, per FIG. 6, will sustain at least twice the stress of the unmodified and un-nitrided base metal alloy when measured for 1% creep extension at 1400° F. in a 100 hour test. Under these test conditions, and within the preferred embodiments, these through-nitrided articles will have 1% creep strength similar to the standard 18Cr-8Ni austenitic grade, i.e. Type 304 stainless steel, as reported in the technical literature. A second feature of my invention is an increase in yield strength in the through-nitrided articles at room temperature to 1000° F. of at least 10KSI (10,000 pounds per square inch), over similar base materials subjected to high temperature thermal cycles, i.e. the nitriding and denitriding described herein. Similar thermal cycles are often used in fabricating heat-recovery devices by brazing, hence, the ferritic stainless steels not treated in accordance with my invention will have properties more like these shown in Table III for the simulated nitrided condition, as opposed to those shown for the mill annealed condition.

TABLE III

TENSILE PROPERTY COMPARISON OF ANNEALED VS. NITRIDED MATERIALS

| ALLOY NO. | CONDITION | TEST TEMP. (°F.) | 0.2% YIELD KSI | ULTIMATE (KSI) | ELONGATION (%) | NOTES |
|---|---|---|---|---|---|---|
| 1 | MILL ANNEALED | ROOM | 35 | 65 | 25 | (1) |
| 1 | " | 1000 | 20 | 40 | 20 | (1) |
| 1 | SIMULATED NITRIDED | ROOM | 31 | 50 | 21 | (2) |
| 1 | NITRIDED | ROOM | 54 | 93 | 20 | (3) |
| 1 | NITRIDED | 1000 | 30 | 49 | 28 | (3) |
| 4 | MILL ANNEALED | 1500 | 4.2 | 6.6 | 70 | (1) |
| 4 | NITRIDED | 1500 | 14.4 | 17.7 | 19 | (3) |
| 4 | NITRIDED | ROOM | 60.5 | 116.8 | 6 | (3) |
| 5 | MILL ANNEALED | ROOM | 55 | 78 | 30 | (4) |
| 5 | " | 1000 | 25 | 40 | 12 | (4) |
| 5 | SIMULATED NITRIDED | ROOM | 48 | 63 | 15 | (2) |
| 5 | NITRIDED | ROOM | 63 | 115 | 15 | (3) |
| 5 | NITRIDED | 1000 | 47 | 90 | 12 | (3) |
| 6 | MILL ANNEALED | ROOM | 65 | 98 | 32 | (5) |
| 6 | " | 1000 | 33 | 62 | 23 | (5) |
| 6 | SIMULATED NITRIDED | ROOM | 50 | 64 | 10 | (2) |
| 6 | NITRIDED | ROOM | 75 | 125 | 11 | (3) |
| 6 | NITRIDED | 1000 | 49 | 81 | 16 | (3) |
| 7 | NITRIDED | ROOM | 69 | 92 | 25 | (3) (6) |
| 8 | MILL ANNEALED | ROOM | 36 | 62 | 35 | (7) |
| 8 | NITRIDED | ROOM | 51 | 81 | 25 | (3) |

NOTES
(1) STANDARD AISI 409, 0.010" THICK, TYPICAL MILL PROPERTIES (UNNITRIDED, NOT MODIFIED).
(2) NITRIDE TEMPERATURE SIMULATED IN $H_2$, FOLLOWED BY STANDARD DENITRIDE CYCLE AND COOL.
(3) NITRIDED AT 1600–1700° F. IN PREFERRED RANGE FOR MAXIMUM CREEP LIFE.
(4) SIMILAR TO ALLOY 5; MATERIAL CONTAINS APPROX. 0.4% Cb, NO Ti.
(5) SIMILAR TO ALLOY 6; MATERIAL CONTAINS APPROX. 0.6% Cb, NO Ti.
(6) ALLOY 7 IS ESSENTIALLY THE SAME AS ALLOY 5 EXCEPT FOR LOWER Ti, HENCE PROPERTIES OF MATERIAL PRIOR TO NITRIDING WILL BE AS SHOWN FOR ALLOY 5 IN MILL ANNEALED CONDITION.
(7) LITERATURE DATA

The high temperature creep properties of my Alloys 1 and 5 (see Table I), were compared to those of AISI Type 316 stainless steel and the results are tabulated below in Table IV. It is apparent from these data that ferritic stainless steels modified and nitrided in accordance with my present invention show significantly greater creep resistance and rupture strength than the Type 316 stainless steel.

TABLE IV

CREEP TEST RESULTS AT 1800° F. (0.010 INCHES THICK)

| MATERIAL | NITRIDING TEMP. (°F.) | STRESS (KSI) | HOURS TO PRODUCE 1% CREEP | HOURS TO PRODUCE RUPTURE | ELONGATION % |
|---|---|---|---|---|---|
| ALLOY 1 | 1600 | 4.0 | 2.0 | 6.0 | 10 |
| ALLOY 5 | 1630 | 4.0 | 64* | GREATER THAN 105 | DISCONTINUED |
| ALLOY 5 | 1630 | 5.0 | 22.2 | — | DISCONTINUED |
| AISI 316 | NONE** | 4.0 | 0.08 | 4.7 | 45 |

*SAMPLE SHOWED 0.6% CREEP AT ABOUT 60 HOURS, AFTER WHICH CONTROL THERMOCOUPLE BURNED OUT.
**316 STAINLESS WAS 0.010 INCHES THICK, IN MILL ANNEALED CONDITION.

Since the alloys in accordance with the present invention exceed Type 316 stainless steel creep strength when tested by the conventional direct ASTM method, it is expected that such alloys will also exceed Type 316 stainless steel creep strength when subjected to the 982° C. Sag Test, which has been used as an indirect determination of elevated temperature creep strength.

It is well known in the art that ferritic type stainless steels, at similar chromium levels, have superior cyclic oxidation resistance above about 1500° to 1600° F., to the austenitic type stainless steels, which are based on the 18–8 composition, i.e. Type 302, 304, 316, 347, etc. Therefore, it is believed that the alloys in accordance with my present invention at comparable chromium levels, will have oxidation resistance superior to that of AISI Type 316 austenitic stainless steels, by the Cyclic Oxidation Resistance Test.

Even though, as shown in Table III above, the ductility (% Elongation) of my nitrided material is less than the ductility of the un-nitrided mill annealed material, the ductility of my nitrided material is such that it exhibits good room temperature formability.

Elements other than iron and titanium are present in the material for improved resistance to corrosion and oxidation, and additional strengthening. Chromium of at least 10 percent is necessary to impart stainless properties, and may be present up to about 30 percent. The preferred range is 14 to 20 percent. It is well known in the art, that increasing the silicon content of stainless steels improves castability and increases oxidation resistance. However, in connection with materials to be nitrided in accordance with my present invention, a silicon content above about 1% is believed to slow the nitriding rate and, hence, increase the required nitridation treating time. Accordingly, silicon in amounts of up to about 1%, e.g. about 0.3 to about 1% is acceptable in respect to the stainless steels of my present invention.

Molybdenum, which not only improves corrosion resistance, but, in addition, enhances strength, may be present in the 0 to 5 percent range, with a preferred range of 1.5 to 3.5 percent. In some cases it may be desirable to replace molybdenum with tungsten. Test data for molybdenum containing alloys 5 to 8 (Table I) are given in Tables II and III. Additional data for alloy 5 are given in Tables IV and V. In Table V, time to 1% creep extension at 1400° F. under a stress of 11,000 psi may be compared to nitriding temperature for alloy 5; the results are similar to those in FIG. 3 for alloy 1, but give longer times for a higher stress level. Thus, one of the benefits of molybdenum additions, as exemplified by alloys 5–8 from Table I, is the markedly improved creep strength over the molybdenum-free materials such as alloy 1. The peak strength temperature for nitriding still lies in the 1525° to 1750° F. range, however, and leads to yield strengths at 1000° F. for these alloys which are at least about 50 percent higher than the nitrided Type 409 (alloy 1) stainless steel as shown in FIG. 1, at the titanium levels shown in Table I for a given thickness. In addition to the above alloying elements, the alloys shown in Table I contain residual carbon, phosphorus, sulfur, nickel, aluminum and balance iron.

While titanium is my preferred nitride former, other nitride forming elements such as vanadium, columbium, aluminum, tantalum, zirconium, hafnium and rare earth metals may be employed, and may be added singly or in combination, to the alloys of my present invention, either in place of titanium, or to achieve added strength, improved oxidation resistance, or other special properties. As most other nitrides are not as stable as titanium nitride, strengthening effects will be significantly less, depending on service temperature. Where another nitride is being formed during the nitriding treatment, the nitriding rate will be correspondingly slower, depending on the amount of the nitride being precipitated, which in turn relates directly to the percent of the element present, and the solubility of the nitride of that element in the base stainless metal. A similar effect is observed as the titanium level is increased, as demonstrated in Table II. Conversely, molybdenum additions do not appear to influence nitriding rates significantly, as similar nitriding rates have been observed with alloys 5 and 6. For example, in Table III, the nitriding time for alloy 5 at 1650° F. was 35 minutes, and the time for alloy 6 at 1675° F. was 60 minutes. Both points fit well with the curve and data given in FIG. 5 for alloy 1, which has no molybdenum.

In order to achieve the low interparticle spacings in the through-nitrided articles of my invention, i.e. less than 10 microns and preferably less than 2 microns, it is necessary to nitride as quickly as possible within the nitriding range of 1500° F. to 1800° F., preferably near the center of the range, i.e. 1525° F. to 1750° F. For example, in the Arnold et al U.S. Pat. No. 4,047,981, nitriding is conducted in a mixture of hydrogen gas with about 1 to 2 percent nitrogen gas, in such a manner so as to preclude the formation of chromium nitrides at temperatures where a maximum of 5 percent austenite is formed. At a temperature of about 1660° F. (905° C.), a through-nitriding time of over 120 hours was required for a 0.050 inch thick ferritic stainless steel (Heat A) having a composition essentially within the ranges set forth in my invention. When corrected for the differences in thickness (using the relation $X^2=kt$), this would correspond to a nitriding time of almost five hours for 0.010 inch thick material, whereas, as shown in FIG. 5 herein, a minimum time of 25 minutes is required with ammonia at 1660° F. in accordance with my invention, and typically, the working times are less than one hour. As a result of the slow nitriding process employed by Arnold et al, the interparticle spacing apparently was so large as to give no increase in yield strength at room temperature. Conversely, a slight de-

TABLE V

| | | PROPERTIES OF NITRIDED ALLOY 5 (0.010 INCHES THICK) | | | | |
|---|---|---|---|---|---|---|
| | | TENSILE RESULTS AT 1000° F. | | | CREEP-RUPTURE LIFE HOURS AT 1400° F./11 KSI | |
| ALLOY NO. | NITRIDING TEMP., °F. | 0.2% YIELD | UTS | % ELONG. | 1% CREEP | RUPTURE |
| 5 | NONE | 23 KSI | 37 KSI | 15 | — | LESS THAN 1 |
| | | 26 KSI | 45 KSI | 9 | | |
| 5 | 1400 | — | — | — | 8.4 | 13.9 |
| 5 | 1500 | — | — | — | 546.0 | 1491 |
| 5 | 1650 | 46 KSI | 88 KSI | 13 | 3475 | DISCONTINUED |
| | | 49 KSI | 95 KSI | 12 | | |
| 5 | 1800 | — | — | — | 174.0 | 300.0 |
| 5 | 1900 | — | — | — | 8.0 | 32.9 |

crease was reported, probably due to grain growth during nitriding.

The formation of fine titanium nitride particles during the nitriding process is a nucleation and growth process, hence, the slower the nitrogen reaches the titanium to form a new nucleus, the longer the titanium has to diffuse to existing particles and make them larger. See Lynn Edward Kindlimann, "Strengthening of Austenitic Stainless Steels by Internal Nitridation", Ph.D. Thesis, Rensselaer Polytechnic Institute, Troy, N.Y. (June, 1969). Thus, a slow moving nitrogen front as described in Arnold et al U.S. Pat. No. 4,047,981 will lead to only a few nuclei, with resulting large particles and large interparticle spacing. In addition to slow nitrogen diffusion caused by the dilute supply of nascent nitrogen [N] from the reaction $N_2 \rightarrow 2[N]$, the diffusion rate itself is a parabolic function of the depth from the surface, i.e. $X^2=kt$, as described previously, and, accordingly, the nitriding rate decreases with depth, which also results in fewer nuclei and a greater interparticle spacing. Although the basic law of diffusion cannot be changed, a finer interparticle spacing can be achieved through selection of a temperature where both nitrogen diffusion is rapid and a large number of nuclei form. In addition, the nitriding rate can be maximized by maintaining a high effective level of atomic nitrogen [N] in the surface of the work piece.

The nitriding treatment for strengthening in accordance with my present invention is performed in the presence of a non-oxidizing nitrogen-containing atmosphere, preferably undissociated ammonia, or a mixture of the same with other non-oxidizing gases, to effect rapid nitriding. Oxygen tends to interfere with the absorption of nitrogen into the surface of the work piece -hence the non-oxidizing environment. In practice, any process which supplies atomic, or nascent nitrogen to the surface of the work piece, is acceptable. Thus, undissociated ammonia, $NH_3$, becomes $[N]+3[H]$ on the surface, where atomic nitrogen [N] is rapidly absorbed, as opposed to $2NH_3 \rightarrow N_2+3H_2$ (the final breakdown products when ammonia decomposes due to heat), where the reaction of nitrogen as $N_2 \rightarrow 2[N]$ is much slower (as is generally the case of nitrogen gas, $N_2$). A release of [N] from another chemical source, or from $N_2$ aided by high energy electrical discharge, i.e. ionitriding, would be other possible sources of nascent nitrogen [N] within the concepts of this invention. Even an atmosphere comprising a mixture of nitrogen and hydrogen may be employed, though less effective than the above nitriding atmosphere. If the rate of internal nitriding takes place too slowly the dispersoid will grow during treatment, providing less than the optimum strength increase, hence the need to maintain a ready supply of nascent nitrogen at the work piece surface, such as by dissociation $NH_3$ on the work piece. Conversely, if the nitriding time is extended greatly beyond the time needed to react all of the titanium, i.e., to through nitride, excess chromium nitride will form and lead to the pore formation previously described.

According to Carl Wagner, *Z. Elektrochem,* 63 (1959) pp 772–782 and Robert A. Rapp, *Corrosion,* 21 (1965) pp 382–401, the depth of internal oxidation (nitridation) may be calculated by the equation:

$$\xi = \left\{ \frac{2N_N^{(s)} D_N t}{\nu N_{Ti}^{(o)}} \right\}^{\frac{1}{2}}$$

Where:

$\xi$=depth of internal nitridation $N_N^{(s)}$=mole fraction of N established at the surface $D_N$=diffusion co-efficient of N in the region 0 to $\xi$ t=time $N_{Ti}^{(o)}$=original mole fraction of Ti in the steel v=ratio of N atoms to Ti atoms in precipitate=1 until chromium nitrides are formed. However, when chromium nitrides begin to form, the rate of motion of the titanium nitride front increases significantly. Hence, when chromium nitride forms, its depth must also be considered, where upon:

Depth TiN=$\xi$(as above)+f(function of chromium nitride depth)

For fastest nitriding it is desirable to form chromium nitride in addition to the titanium nitride. The diffusion *rate* of nitrogen is controlled by the nitrogen *gradient,* i.e. by the *amount* of nitrogen in solid solution at the surface of the work piece. This amount will be limited by the solubility of chromium nitride, i.e. above a given nitrogen level at the surface, chromium nitride will begin to precipitate, and in contrast to the method of Arnold et al, U.S. Pat. No. 4,047,981, during my nitriding cycle a substantial amount of austenite will form as chromium is removed from solid solution as the nitride. This austenite is eliminated, however, during my subsequent denitridation or annealing, so that the finished stainless steel in accordance with my present invention, is substantially free of austenite or martensite. By deliberately forming chromium nitride as fast as possible, such that a chromium nitride front passes into the material in much the same manner, but slower than, the titanium nitride front, the through-nitriding rate can be markedly increased, the time to nitride decreased, and a correspondingly smaller interparticle spacing achieved. This is because the nitrogen solubility limit (as chromium nitride) is actually moving into the work piece, which is, in effect, the equivalent of moving the original outer surface into the work piece, giving a higher diffusion gradient and, hence, higher diffusion rate, than can be obtained if no chromium nitride were formed. This can be explained mathematically using the laws of diffusion, and is detailed in the earlier referenced Kindlimann Ph.D. Thesis.

Undesirable pore formation is related to the formation of chromium nitride which occurs while the titanium nitride reaction is proceeding, but at a significantly lower rate of penetration into the work piece. The amount of chromium nitride formed is greater for lower nitriding temperatures, longer nitriding times, and higher amounts of chromium in the alloy. Excessive nitriding treatment results in formation of excessive chromium nitride which embrittles the stainless steel and when the stainless steel subsequently is subjected to a non-nitrogen atmosphere at elevated temperatures to reduce the chromium nitrides (i.e. denitriding), excessive pore formation often results. Consequently, the time of ammonia flow (or nascent nitrogen supply) should be only long enough to saturate the ferritic stainless steel cross-section and react all of the titanium with nitrogen. Because of the many parameters involved, this time must be determined empirically for a given steel of known thickness in a given environment at a given temperature, although reference times may be obtained from FIG. 5, as discussed previously. Similarly, the ammonia flow rate will be a function of the workload, and the geometry and size of the nitriding chamber.

Hence, the time to which the ferritic stainless steel material is subjected to the nitridation treatment at elevated temperatures should be just enough to react nitrogen with the titanium content of the alloy. If the time is not sufficient to cause reaction of all of the titanium, then a stable through-nitrided material may not be obtained, although it is recognized that excess nitrogen near the surface may subsequently diffuse more deeply into the cross section and form a dispersoid with the unreacted titanium. Under some circumstances, this "partial nitriding technique" is a useful technique to reduce total treatment time and attendant cost. For example, a given titanium-containing ferritic stainless steel within the scope of this invention might be nitrided continuously on a moving line to effect surface saturation with nitrogen, but not complete the through-thickness reaction. Subsequent reheating for removal of excess nitrogen as chromium nitride will allow the titanium nitride reaction to be completed, if sufficient chromium nitride is present to supply the necessary nitrogen, as the chromium nitride is decomposed and the released nitrogen then combines with any unreacted titanium. Strength, of course, will depend on the temperature at which the titanium nitride is formed, which is preferably within the range of 1525° F. to 1750° F., and definitely below about 1800° F. A material produced in accordance with the above described "partial nitriding technique", however, will not be as strong as one which has been through-nitrided in the nascent nitrogen environment.

Figure 7:
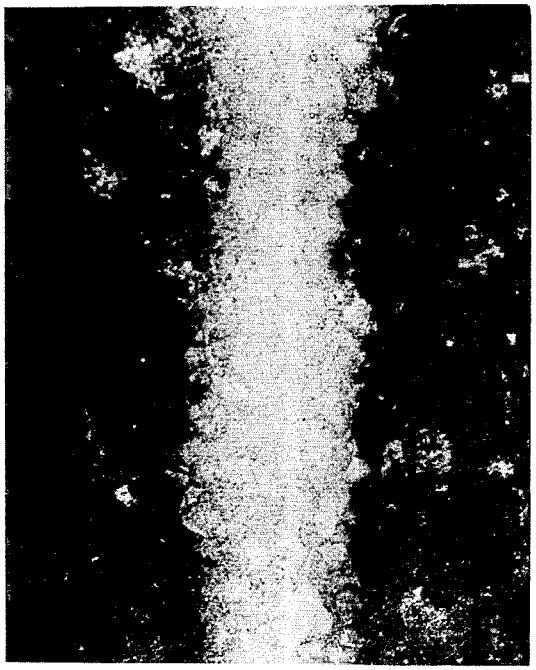
FIG. 7 is a photomicrograph of a cross-section of thin gage strip of ferritic stainless steel modified and through-nitrided in accordance with my present invention.

FIG. 7 is a photomicrograph taken at 450× of alloy 4, taken after nitriding the 0.007 inch (7 mils) thick work piece for approximately 2 hours at 1700° F. with ammonia flowing over the work piece in the equipment described above. The darkened area in the photomicrograph adjacent to the outer surface of both sides of the work piece represents titanium nitride plus the chromium nitride which was formed due to the excess nitrogen present. The area between the darkened section and the faint center line of the work piece, which is a light area, represents titanium nitride and shows that the depth of nitriding was completely through to the narrow center line which is about 0.1 mil thick. In the center line, there are no nitrides, because of counter diffusion of titanium, i.e. the titanium has migrated toward the external surfaces to react with the nitrogen, leaving a very narrow zone free of titanium or titanium nitrides. There is essentially no unreacted titanium in the material specimen. Hence, FIG. 7 shows that the internal nitriding in accordance with my process is substantially completely through the cross section of the work piece. The material is further treated for removal of the chromium nitride formed, as indicated below.

Figure 8:
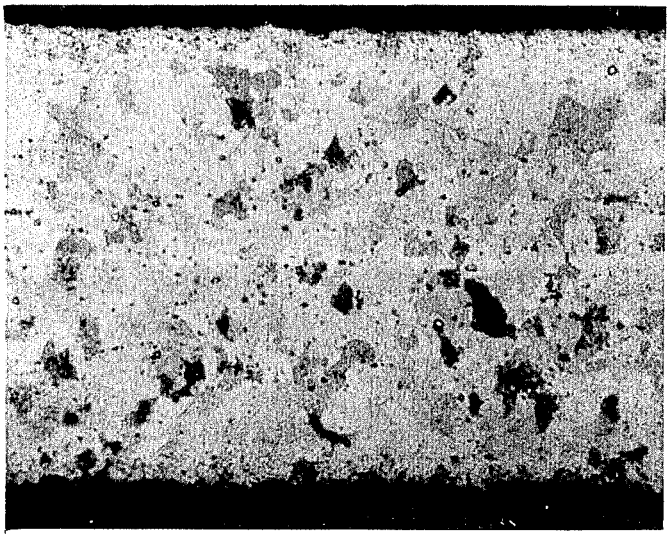
FIG. 8 is a photomicrograph of a cross-section of the strip shown in FIG. 7 after denitriding in accordance with my present invention.

Excessive nitrogen as chromium nitride is removed from the nitrided work piece by a denitriding treatment involving exposure to a hydrogen or comparable non-oxidizing atmosphere, including vacuum, at 2000° F. to 2050° F. for several hours. FIG. 8 is a photomicrograph of an etched specimen of the strip (alloy 4) shown in FIG. 7 at 450× after denitriding at 2035° F. for one hour in accordance with my denitriding method. The chromium nitride indicated by the darkened zone on FIG. 7 is eliminated from FIG. 8. Hence, FIG. 8 shows that the denitridation substantially eliminates the chromium nitrides. This step is necessary to restore ductility and oxidation resistance to material subjected to the optimum through-nitriding treatment described above. This step could be eliminated for material partially nitrided during a continuous line operation as described above, depending on the amount of excess nitrogen which can be tolerated in the material, since it affects oxidation resistance and ductility. To complete the through-nitriding reaction, however, a soak would be required at a temperature below about 1800° F., either prior to, or during, service. Again, strength level would be lower than that achievable through the optimum treatment.

It should be noted that once the nitride particles are formed during nitriding, within the preferred range 1525° F. to 1750° F. it becomes safe to heat the material to above 1800° F. for the denitriding treatment at about 2025° F. Plate-like particles are only formed if the material is nitrided above about 1800° F. Once more equiaxed particles are formed at lower temperatures, they tend to retain their original shape during denitriding, although some growth will occur, leading to a greater interparticle spacing. Accordingly, denitriding time should only be long enough to eliminate the chromium nitrides and reduce the excess soluble nitrogen to an acceptable level. Denitriding is performed in a non-oxidizing atmosphere to prevent the formation of chromium oxides in the nitrided ferritic stainless steels of my present invention. Denitriding of the alloys shown in Table I can typically be accomplished in under three hours for 0.010 inch thick material. Thus after denitriding, the finished through-nitrided ferritic stainless steels in accordance with my present invention, are substantially free of chromium nitrides. The denitrided steels may then be subjected to whatever conventional subcritical annealing treatment may be needed for the particular ferritic stainless steel product, in accordance with standard practice.

To obtain the optimum nitriding rate with a given supply of nascent nitrogen, it is essential that the surface of the material be clean and free of oxides. Some improvement in nitriding rate is also found when the material is in the cold-worked, rather than annealed condition, as nitrogen diffusion is aided by recrystallization during treatment. Similarly, grain boundary precipitates are substantially reduced, tending to give higher ductility.

It is apparent that certain modifications of my invention described above, may be made without departing from the scope of the invention. For example, other metal nitride formers, e.g. columbium vanadium, tantalum, zirconium, or aluminum, which are soluble in the base metal, may be used in place of titanium, with satisfactory results except for higher temperature service. Also, alloying elements such as molybdenum, tungsten, aluminum, silicon, etc. may be added to the ferritic stainless steels of my present invention to impart certain additional characteristics or properties, without departing from the spirit of my present invention. Accordingly, my invention is to be afforded the full scope of the appended claims.

What is claimed is:

1. Light gage internally through-nitrided ferritic stainless steel modified to about 0.5–2.25% titanium content and about 0.03% carbon maximum and containing a dispersion of titanium nitride particles at an interparticle spacing of less than about 10 microns, said nitrided ferritic stainless steel having a room temperature tensile yield strength of at least 10,000 psi greater than said ferritic stainless steel without said modification and nitridation, a 1000° F. tensile yield strength of at least 10,000 psi greater than said ferritic stainless steel without said modification and nitridation, and a 1400° F. creep strength (1% creep under load in 100 hours) improvement of at least about 50% over said ferritic stainless steel without modification and nitridation, said comparative tensile yield strengths and creep strength improvements referring to materials subjected to the same heat treatment, and said nitrided ferritic stainless steel being essentially devoid of chromium nitrides and having a high temperature oxidation resistance comparable to the high temperature oxidation resistance of said ferritic steel without said modification and internal nitridation.

2. Internally through-nitrided ferritic stainless steel in accordance with claim 1 wherein said stainless steel contains about 10 to 30% chromium.

3. Internally through-nitrided ferritic stainless steel in accordance with claim 1, wherein said stainless steel contains about 14 to 20% chromium.

4. Internally through-nitrided ferritic stainless steel in accordance with claim 1, wherein said steel contains, in weight percent, about 14 to 20% chromium; about 0.5 to 2.25% titanium; 0.03% carbon maximum; 1% maximum silicon; normal impurity levels of sulphur, phosphorus, nickel, aluminum, copper and manganese, and balance iron.

5. Internally nitrided ferritic stainless steel in accordance with claim 4, wherein said stainless steel contains 0.9 to 1.5% titanium.

6. Internally nitrided ferritic stainless steel in accordance with claim 1, wherein the interparticle spacing of said titanium nitride dispersoid throughout said material averages less than about 2 microns.

7. Internally nitrided ferritic stainless steel in accordance with claim 1, wherein said stainless steel contains up to about 4.0% molybdenum.

8. Internally nitrided ferritic stainless steel in accordance with claim 1, wherein said steel contains about 18% chromium and about 2% molybdenum.

9. Internally nitrided ferritic stainless steel material in accordance with claim 1, containing about 14% chromium and about 4% molybdenum.

10. Internally nitrided ferritic stainless steel in accordance with claim 1, wherein said ferritic stainless steel contains one or more of the elements from the group consisting of aluminum, columbium, tantalum, vanadium, zirconium.

11. A method for internally through nitriding light gage ferritic stainless steel to produce a through-nitrided ferritic stainless steel material having a room temperature tensile yield strength of at least 10,000 psi greater than said ferritic stainless steel without said internal nitridation, a 1000° F. tensile yield strength of at least 10,000 psi greater than said ferritic stainless steel without said internal nitridation, a 1400° F. creep strength (1% creep under load in 100 hours) improvement of at least about 50% over said ferritic stainless steel without said internal nitration, and having high temperature oxidation resistance comparable to such ferritic stainless steel before nitriding, comprising the steps of:

(a) treating said stainless steel with a source of atomic nitrogen in a non-oxidizing environment at a temperature in the range of 1500° F. to 1800° F. for a time sufficient to saturate the ferritic stainless steel cross-section with sufficient nitrogen to react with substantially all the titanium in said material, (b) heating said nitrided material to a temperature in excess of about 1800° F. in a non-oxidizing environment for a time sufficient to decompose substantially all of the chromium nitrides formed during the nitridation process, and (c) cooling said nitrided material to room temperature.

12. The method of claim 11, wherein said nitridation treatment is conducted in the range of 1525° F. to 1750° F.

13. The method of claim 11, wherein said atomic nitrogen environment is ammonia.

14. The method of claim 11, wherein said ferritic stainless steel contains from 10 to 30% chromium, about 0.5 to 2.25% titanium, 0.03% carbon maximum, and the balance iron, with normal level of impurities of nitrogen, sulphur, phosphorus, manganese, nickel, aluminum, copper and silicon.

15. The method of claim 11, for treating light guage stainless steel of about 0.010 inches thickness maximum, wherein said nitridation treatment is performed in about one hour or less.

16. A method for internally through nitriding light gauge ferritic stainless steel to produce a through-nitrided ferritic stainless steel material having a room temperature tensile yield strength of at least 10,000 psi greater than said ferritic stainless steel without said internal nitridation, a 1000° F. tensile yield strength of at least 10,000 psi greater than said ferritic stainless steel without said internal nitridation, a 1400° F. creep strength (1% creep under load in 100 hours) improvement of at least about 50% over said ferritic stainless steel without said internal nitration, and having high temperature oxidation resistance comparable to such ferritic stainless steel before nitriding, comprising the steps of:

(a) treating said stainless steel with a source of atomic nitrogen in a non-oxidizing environment at a temperature in the range of 1500° F. to 1800° F. for a time sufficient to partially nitride the cross section of said material, and (b) heating said partially nitrided material to a temperature below about 1800° F. in a non-oxidizing environment for a time sufficient to decompose substantially all of the chromium nitride formed during said partial nitriding step and combine the remaining unreacted titanium with the nitrogen which is releasd from the decomposition of said chromium nitride.

* * * * *